US008086141B2

(12) United States Patent
Someya et al.

(10) Patent No.: US 8,086,141 B2
(45) Date of Patent: Dec. 27, 2011

(54) ELECTRIC CHARGING APPARATUS AND IMAGE FORMING APPARATUS USING THE SAME

(75) Inventors: Yukimichi Someya, Machida (JP); Eiichi Ohta, Kawasaki (JP); Naomi Sugimoto, Kawasaki (JP); Takuro Sekiya, Yokohama (JP); Yasuo Katano, Yokohama (JP); Shohji Tanaka, Fujisawa (JP); Yoshihiko Iijima, Sendai (JP); Toshihiro Ishii, Sendai (JP)

(73) Assignee: Ricoh Company, Ltd., Tokyo (JP)

( * ) Notice: Subject to any disclaimer, the term of this patent is extended or adjusted under 35 U.S.C. 154(b) by 824 days.

(21) Appl. No.: 11/693,417

(22) Filed: Mar. 19, 2008

(65) Prior Publication Data

US 2010/0073697 A1 Mar. 25, 2010

(30) Foreign Application Priority Data

Mar. 29, 2006 (JP) ..... 2006-091233

(51) Int. Cl.
*G03G 15/02* (2006.01)

(52) U.S. Cl. ..... 399/168; 399/91; 399/100

(58) Field of Classification Search ..... 399/168
See application file for complete search history.

(56) References Cited

U.S. PATENT DOCUMENTS

| | | | | |
|---|---|---|---|---|
| 2005/0099854 | A1* | 5/2005 | Oishi | 365/200 |
| 2005/0179643 | A1* | 8/2005 | Matsuura et al. | 345/107 |
| 2007/0046720 | A1* | 3/2007 | Konno et al. | 347/21 |

FOREIGN PATENT DOCUMENTS

| | | | |
|---|---|---|---|
| EP | 1670015 | A1 | 6/2006 |
| JP | 56-104351 | | 8/1981 |
| JP | 57-178257 | | 11/1982 |
| JP | 63-149669 | | 6/1988 |
| JP | 08-106200 | | 4/1996 |
| JP | 2001-250467 | | 9/2001 |
| JP | 2001-356568 | | 12/2001 |
| JP | 2002-072700 | | 3/2002 |
| JP | 2002-258585 | | 9/2002 |
| JP | 2005-076035 | | 3/2005 |
| JP | 2006-323366 | * | 11/2006 |

OTHER PUBLICATIONS

U.S. Appl. No. 11/406,267, filed Apr. 19, 2006, Sugimoto, et al.

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An electric charging apparatus charges a surface of a charging object. The electric charging apparatus includes an electric field forming device including two electrodes facing each other that form an electric field therebetween. An electron discharging member is provided at a portion of one of the two electrodes that faces the other electrode and discharges electrons into the electric field. The electric charging apparatus also includes a voltage applying controller that controls a voltage applied to the two electrodes. The voltage applying controller selects two or more nonzero intensities of the electric field.

19 Claims, 6 Drawing Sheets

ELECTRIC CHARGING APPARATUS AND IMAGE FORMING APPARATUS USING THE SAME

PRIORITY STATEMENT

The present patent application claims priority under 35 U.S.C. §119 upon Japanese patent application No. 2006-091233, filed in the Japan Patent Office on Mar. 29, 2006, the content and disclosure of which is hereby incorporated by reference herein in its entirety.

BACKGROUND OF THE INVENTION

1. Field of the Invention

Exemplary embodiments generally relate to an electric charging apparatus and an image forming apparatus using the electric charging apparatus, such as printers, copying machines, facsimiles, etc. Further, exemplary embodiments also relate to discharging electrons and reducing deterioration in an electron discharging member.

2. Discussion of the Background

Background electronic photograph processes use corona discharge to uniformly electrify a photoconductor. A corona discharge device usually includes a platinum or tungsten wire electrode with a diameter of about 50-200 μm or a needlelike stainless steel electrode provided in a conductive case. A high-voltage bias of direct current or alternate current is applied between the electrode and the case to ionize molecules of air near the electrode. A photoconductor near the electrode can be evenly discharged using the ions, but ozone and nitrogen oxides are generated because of ionizing air. It is known that the amount of generated ozone and nitrogen oxides becomes as much as 4-10 ppm after a 60-minute electrification. If ozone remains in an image forming apparatus at a high concentration, the surface of the photoconductor can be oxidized, thereby lowering the light sensitivity and/or electrification ability of the photoconductor, and reducing image forming quality. Further, ozone in the image forming apparatus can also accelerate deterioration of the other parts used in the image forming apparatus.

Nitrogen oxides react with the moisture in air generating nitric acid, and react with metal etc., generating a metal nitrate. Although these reaction products have a high resistance in a dry environment, under highly damp conditions, they react with moisture in the air and have a low resistance. Therefore, if a thin film of nitric acid or a nitrate is formed on the photoconductor surface, an unusual image such as flowing images can be formed. This is because the nitric acid and nitrates generated have a low resistance due to absorbing moisture from the air, and thereby a potential of electrostatic latent image on the surface of the photoconductor is decreased. Since the generated nitrogen oxides remain in the air without being decomposed after electric discharge, adhesion of the compounds generated from nitrogen oxides on the photoconductor surface can occur during a non-discharge period or a non-operation period of image forming processes. The compounds can permeate the inside of the photoconductor as time passes, thereby causing deterioration of the photoconductor. A cleaning method is known in which the adhesion layer on the surface of the photoconductor is removed by shaving off the photoconductor surface little by little. However, this cleaning method is costly and the deterioration problem can remain.

In corona electrification methods, the applied voltage can be as high as about 4-10 kV to cause the electric discharge between separated electrodes. The electrification potential can change depending on the electrification time according to a rotation speed of the photoconductor and its passing by the electrification component. In order to obtain the required electrification potential (400V-1000V), it is necessary to enlarge the width of the case electrode in the direction of the rotation of the photoconductor, especially when the photoconductor rotation speed is high. Therefore, there is a problem that it is hard to miniaturize an image forming apparatus with a quick print speed. In recent years, proximity roller electrification methods have become widely used. In these electrification methods, a direct current (dc) or alternate current (ac) bias is applied between an electrification component (charge roller) supported so as to be close to a photoconductor and the photoconductor, thereby causing electric discharge therebetween, so that the photoconductor is electrified. The electrification phenomenon in accordance with Paschen's electric discharge rule is used in this proximity roller electrification method. The desired electrification potential is obtained by making a large potential difference therebetween which is the same as an electric discharge starting potential. In the case of applying an ac bias, the direction of electric field alternatively changes with time between the proximity electrification component and the photoconductor to thereby repeat electric discharge and reverse electric discharge. Although there is an advantage that the electric field is uniformly equalized by electric discharge and reverse electric discharge using the ac bias, the risk of photoconductor contamination due to electric discharge is still very high.

Thus, electrification of the photoconductor using Paschen electric discharge still includes the risk that electric discharge generation products can adhere to the photoconductor surface or that the photoconductor surface becomes oxidized by an active gas produced by the electric discharge. Therefore, the surface of the photoconductor still must be minutely shaved off in order to maintain image quality. However, it is desirable to avoid having to shave off the photoconductor surface to extend the life of the photoconductor. This loss of life is the trade-off from the use of shaving to prevent degradation of image quality. A contacting charging apparatus in which the electrification component contacts the photoconductor to electrify the photoconductor has also been proposed and used. For example, a roller-like electrification component contacts the photoconductor and is rotated with the photoconductor to charge the photoconductor. This contacting charging method only produces a small amount of ozone. For example, the amount of generated ozone after a 60-minute contacting electrification using a dc voltage bias is about 0.01 ppm. This value is smaller than that of the corona electrification method. Further, since the applied voltage is low, it has advantages of reducing the cost of the power supply and reducing the difficulty of designing the electric insulation. Of course, the problems caused by the above-mentioned ozone and NOx can also be reduced.

In the above-mentioned contacting charging method, a narrow space is formed at the position of the contact or near the proximity portion, the electric discharge in accordance with Paschen's law is made, and the photoconductor is charged. Further, a method of applying a dc voltage that is higher than the electrification starting potential to a conductive component, or promoting equalization of electrification by applying an oscillating voltage superimposed with an ac voltage on the dc voltage equivalent to target electrification potential can be used. However, if an ac voltage is applied, the direction of electric field alternatively changes between the electrification component and the photoconductor. Electric discharge and reverse electric discharge are repeated as noted above. Although there is an advantage that the electric field is uniformly equalized by electric discharge and reverse electric discharge, the amount of generated ozone and nitrogen oxides increases due to increased current, for example. Depending on this current increase, ozone of no less than 3 ppm can be generated after 60-minute electrification similarly to the corona electrification method. As another method, contacting the above-mentioned conductive component with the photoconductor and charging the trap level on the photoconductor surface can be performed. In this method, the conductive component (charge roller) is generally used to conveniently control the shape or condition of the contacting portion.

However, contacting the roller conductive component to the photoconductor includes many disadvantages. For example, when a copy machine is stopped for a long period of time, the roller in contact with the photoconductor can deform because the electrification component is usually a rubber material. Moreover, since rubber is a material which easily absorbs water, its resistance can largely change according to an environmental water content change. Furthermore, rubber needs several kinds of plasticizers and an active agent for providing elasticity without deterioration. In order to distribute conductive pigments, it is common to use an auxiliary distributing agent. That is, since the surface of the photoconductor is made of an amorphic resin, such as polycarbonates or acrylics, the surface has low resistance to the effects of the above-mentioned plasticizers, active agents, and the auxiliary distributing agents. Moreover, a foreign substance can be present between the electrification component and the photoconductor when using the contact electrification method, so that the electrification component is polluted as a result, and poor electrification can occur. Furthermore, since the roller is in contact with the photoconductor, the photoconductor becomes polluted after a long period of time, therefore a poor image, such as one with abnormal horizontal lines, can be generated.

Recently, attention has been directed to a method using electronic discharge material relative to electrification technology. Research on carbon nano material has rapidly progressed in recent years and suggests a high electron discharge ability. It has been reported that a carbon nanotube tip portion can be made to have durability by specifying the constituent factor of the carbon nanotube, and it can be used to be in or out of contact with a charging apparatus. It is also known that an image bearer is electrified as a source of electronic discharge based on the Paschen electric discharge between the parallel plates and the specified field intensity between the charging apparatus surface and the charged body. However, since carbon nano material is organic matter, the carbon nano material itself can be oxidized with the oxygen atom which is excited by an emitted electron just like in the atmosphere of an electronic photograph system. Thus, the carbon nano material can be decomposed by combustion, so that there is a problem that a desired life expectancy cannot be attained due to a resulting very weak structure.

SUMMARY OF THE INVENTION

Exemplary embodiments of the present invention are directed to an electric charging apparatus and an image forming apparatus using the electric charging apparatus, capable of stably discharging electrons and reducing deterioration in an electron discharging member. In these exemplary embodiments, an electric charging apparatus may include an electric field forming device including two electrodes facing each other to form an electric field therebetween. An electron discharging member is provided at a portion of one of the electrodes facing the other electrode, to discharge electrons into the electric field. A voltage applying controller is provided to control voltage applied to the electrodes and to select two or more intensities of the electric field.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
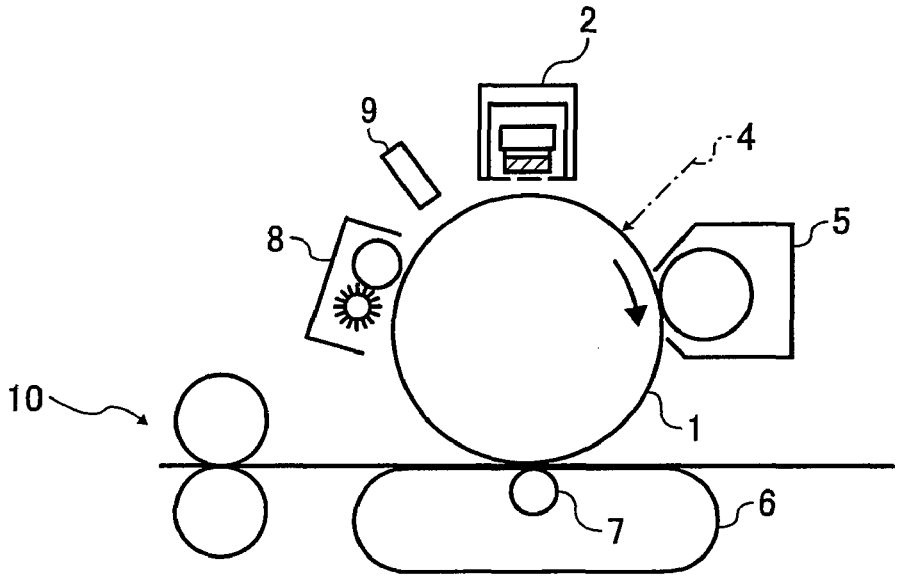
FIG. 1 is a cross-sectional diagram illustrating an image forming apparatus which includes an electric charging apparatus according to an exemplary embodiment of the present invention.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an example of an image forming apparatus is explained.

FIG. 1 is a cross-sectional diagram illustrating an image forming apparatus which includes an electric charging apparatus according to an exemplary embodiment of the present invention. FIG. 1 illustrates a photoconductor drum 1, an electrification device 2, a writing light 4, a developing device 5, a conveyance belt 6, a transferring device 7, a cleaning device 8, a neutralization device 9, and an image fixing device 10. The photoconductor drum 1 includes a conductive base and a photoconductor layer. The electrification device 2 is so provided that it faces the photoconductor drum 1. The gap between the electrification device 2 and the surface of the photoconductor drum 1 is 1 mm. The negative ions generated by applying voltage to the electrification equipment 2 adhere on the surface of the photoconductor, and the photoconductor becomes electrified (charged). After the electrification, the photoconductor drum 1 rotates at a speed of 200 mm/sec. An electrostatic latent image is formed on the photoconductor drum 1 by the writing light 4 from a non-illustrated writing device. The developing device 5 develops the electrostatic latent image into a visible image using a developer such as toner. The toner image on the photoconductor drum 1 is transferred onto a transferring medium, such as a recording sheet, with the transferring device 7. The cleaning device 8 cleans waste toner on the photoconductor drum 1 after transferring. After that, the electricity on the photoconductor drum 1 is removed with the neutralization device 9, if needed. The photoconductor drum 1 is charged again, thus, the image forming process is repeated. The waste toner can be retrieved with the developing device without the process of cleaning.

Figure 2:
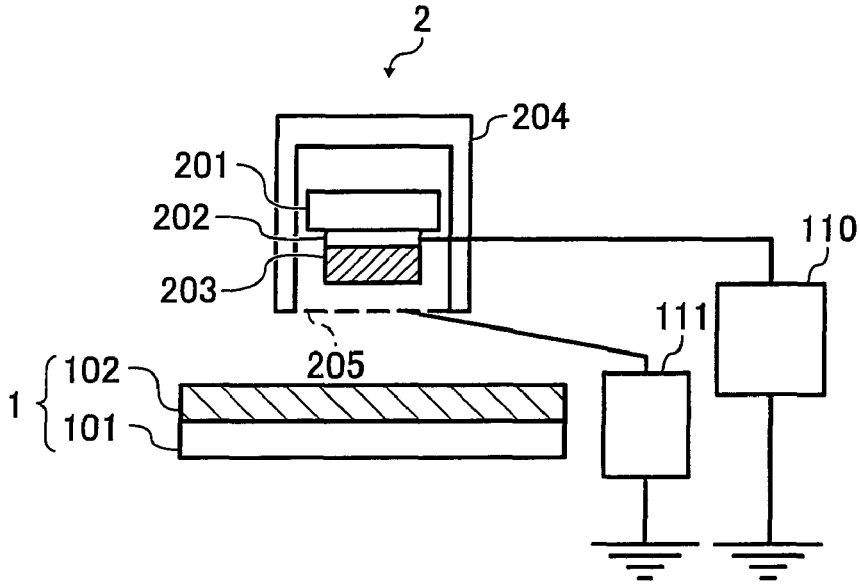
FIG. 2 is a cross-sectional diagram illustrating the electric charging apparatus of FIG. 1.

FIG. 2 is a cross-sectional diagram illustrating the electric charging apparatus of FIG. 1. FIG. 2 illustrates a conductive base 101, a photoconductor layer 102, power sources 110, 111, a support member 201, an electrode 202, an electron discharge layer 203, a case 204, and a grid 205 as an opposite electrode. The electrode 202 and the electron discharge layer 203 are so formed that thin films or particles are distributed and fixed on the support member 201 to face the grid 205. The electrode 202 can have a thickness range of 0.1 nm-10 μm. The electrode 202 of the exemplary embodiment has a preferred thickness of 100 nm. A metal, such as Ni, Cr, Au, Cu, W, Pt, Al, Fe, Mo, Ti, Ag, Mn, Zr, Co, Pb, Ru, and Ta, can be used as the material of the electrode. Cr, which is advantageous in productivity and heat resistance, is used in the exemplary embodiment. The case 204, which is insulative, is provided over the support member 201, the electrode 202, and the electron discharge layer 203. One side of the case 204 has the grid 205, which is made of stainless steel, facing the photoconductor 1. The power source 111 is connected with the grid 205. A stainless plate of honeycomb structure generally used in a scorotron electrification system is used as the grid 205. A conductive film in which an electron passes or a conductive board-like member also can be used as the grid 205.

Figure 3:
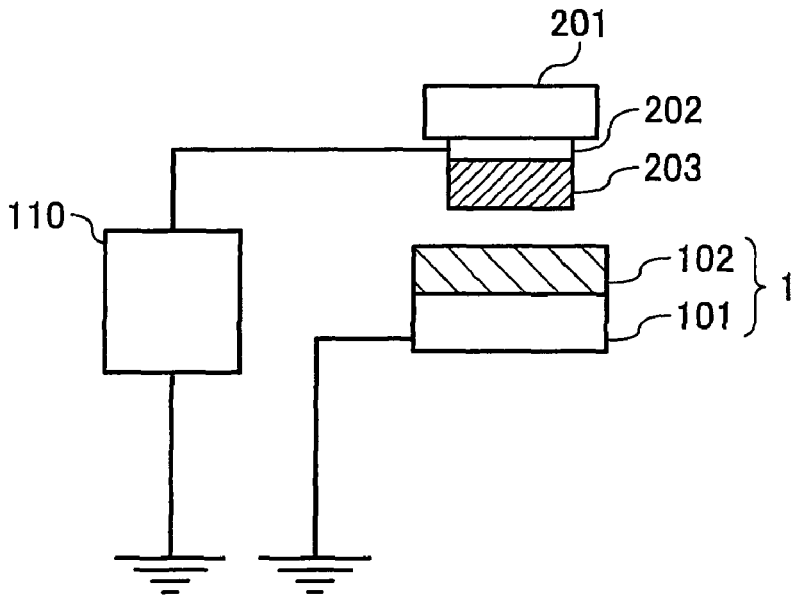
FIG. 3 is a cross-sectional diagram illustrating an electric charging apparatus for experiment according to an exemplary embodiment of the present invention.
Figure 4:
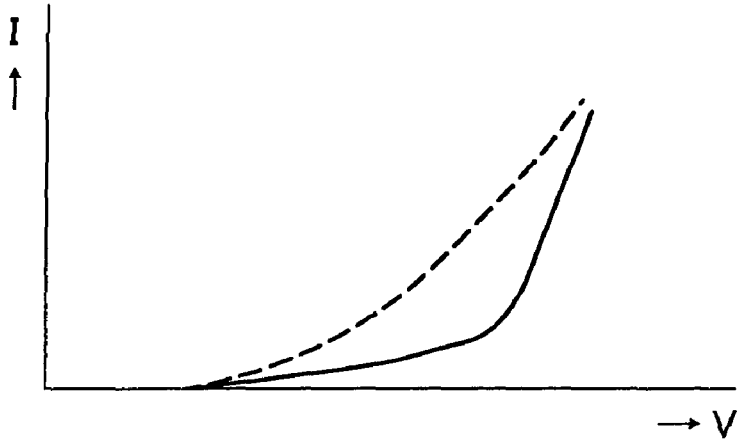
FIG. 4 is a graph illustrating a volt-ampere characteristic of the experimental result of FIG. 3.

The voltage of the power source 110 is applied to the electrode 202, so that an electric field is formed between the electrode 202 and the grid 205 discharging electrons from the electron discharge layer 203. The discharged electrons adhere to gas molecules in the atmosphere, for example, oxygen, carbon dioxide, nitrogen, or these molecules with water. Then, a negative ion is generated and the negative ion passes through the grid 205 acting as an accelerating electrode, so that the negative ion adheres to the photoconductor 1 to charge the photoconductor 1. The image forming apparatus of this invention uses an electronic discharge element as the electric charging apparatus, and is characterized by carrying out electronic discharge from the electronic discharge element and electrifying the surface of an image bearer. The electron discharge layer 203 is formed as a film of SP3-bonded Boron Nitride (BN), which has excellent characteristics as an electron discharge material. The inventors found that making boron nitride BN as a film as described below provides an excellent field-electron-discharge characteristic FIG. 3 is a cross-sectional diagram illustrating an electric charging apparatus used in an experiment according to an exemplary embodiment of the present invention. FIG. 4 is a graph illustrating a volt-ampere (V-I) characteristic of the experimental result of FIG. 3. When the electrostatic property of the electric charging apparatus was measured, the following results were obtained. Using the FIG. 3 illustrated support member 201, the electrode 202, the electron discharge layer 203, and the photoconductor 1 as an opposite electrode, the relation between the applied voltage to the electrode 202 and the element current was measured. A gap for electric discharge of 50 μm was used, and only the charging operation of FIG. 1 was done. Immediately after creating an electronic discharge section including the support member 201, the electrode 202, the electron discharge layer 203, the V-I characteristic was as shown in the solid line of FIG. 4. It was noted that when the voltage exceeded a certain predetermined value, the current increased rapidly. After that, a second measurement of the V-I characteristic was made and is shown by the FIG. 4 dotted line. The result is clear a changed characteristic having a voltage value larger than the value of initial applying voltage even under the condition of low voltage. In subsequent measurements, the same V-I characteristics as those shown by of the dotted line of FIG. 4 were obtained, indicating that the V-I characteristic had stabilized. It is theorized that the path of electrical connection from the electric conduction base to the thin film of the electronic discharge section is in a developing condition in early stages at the start of the initial electric discharge, and that the electrical connection path becomes stabilized by the high field intensity generated against the opposite pole by applying a high voltage.

Figure 5:
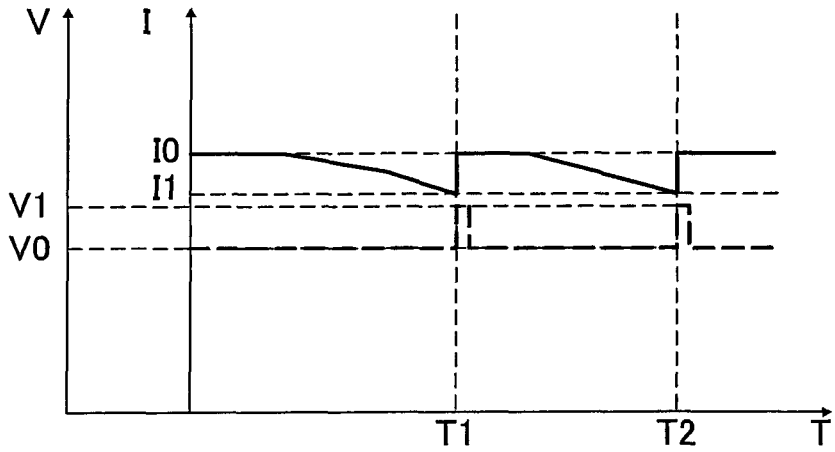
FIG. 5 is a graph illustrating the relation between element current and time as the experimental result of FIG. 3.

FIG. 5 is a graph illustrating the relation between element current and time as a further experimental result of FIG. 3. In FIG. 5, a separate vertical axis shows current (I) and voltage (V), and a horizontal axis indicates time (T). In FIG. 5, the solid line shows a current value, and a thick dotted line shows a voltage value. The notation I0 shows a target current value, I1 shows a low-current value, V0 shows a predetermined voltage value, and V1 shows a high-voltage value. The variation of the element current I was measured at the predetermined voltage V0 under the same condition of the above-mentioned configuration. When voltage V0 was applied continuously, the element current fell to I1 from I0 in time T1. However, when the high voltage V1 was applied temporarily, even if the voltage was then returned to the predetermined state V0, the current increased to the original value I0 for a time period after V1 returned to V0. Furthermore, when this time passed, the current value fell similarly. However, when the high voltage V1 was again temporarily applied at the time T2, a similar change in current arose. The voltage V1 needed to produce the above-mentioned increase in current (recovery from I1 back to I0) was near the voltage for starting electric discharge based on the Paschen rule. The reason for these results is unknown, but it is theorized that an inhibitory substance in the atmosphere adheres to the electronic discharge element surface and the discharge capability thereof is reduced. As field intensity becomes high by applying the high voltage, a phenomenon of exfoliating by a high energy electron (thermal spray) may occur.

Figure 6:
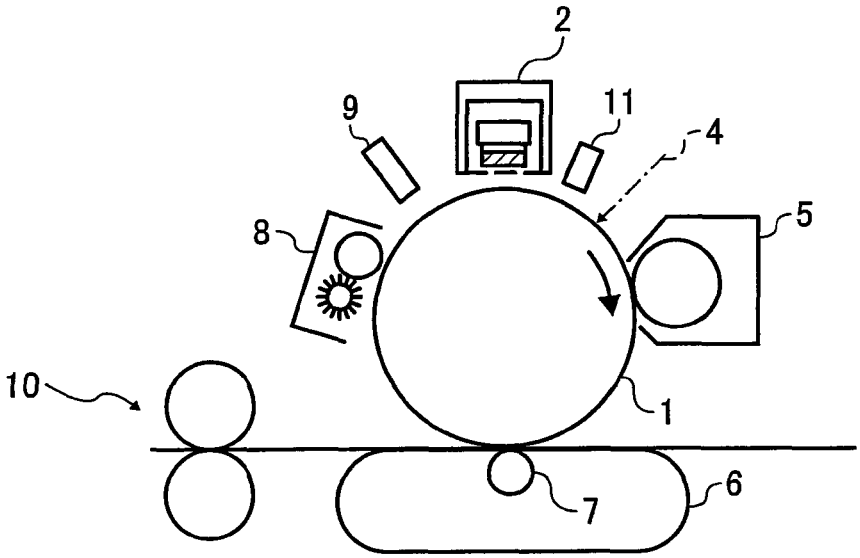
FIG. 6 is a cross-sectional diagram illustrating an image forming apparatus which includes an electric charging apparatus according to an exemplary embodiment of the present invention.
Figure 7:
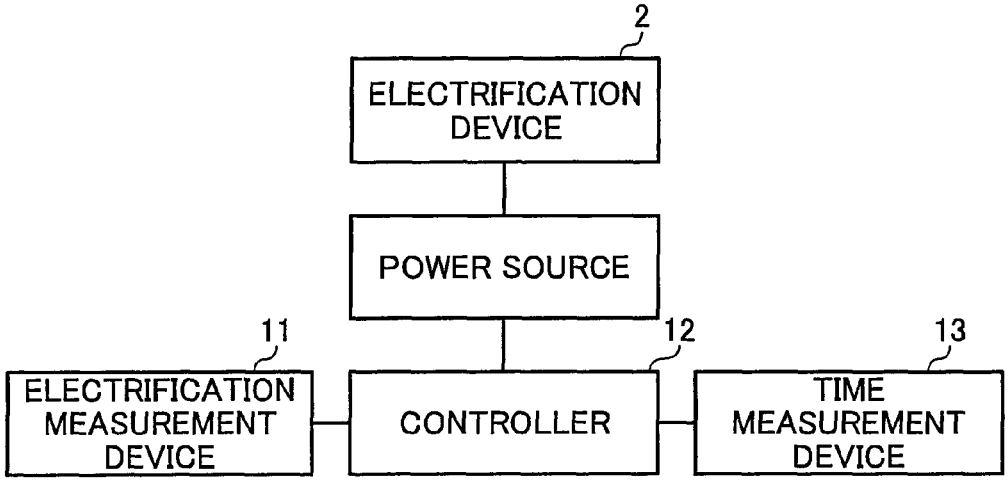
FIG. 7 is a block diagram illustrating a configuration of a controller of the electrification measurement device of FIG. 6.

FIG. 6 is a cross-sectional diagram illustrating an image forming apparatus which includes an electric charging apparatus according to an exemplary embodiment of the present invention. In FIG. 6, an electrification measurement device 11 is illustrated. FIG. 7 is a block diagram illustrating a configuration of a controller of the electrification measurement device of FIG. 6. In FIG. 7, a controller 12 and a time measurement device 13 are illustrated. The electrification measurement device 11 is provided at the down-stream position of the electrification device 2, facing the surface of the photoconductor 1 and measuring the electrification on the surface of the photoconductor 1. The remainder of the FIG. 6 configuration is similar to that of FIG. 1, so that a description thereof is omitted. A main body of the image forming apparatus that is not shown includes the controller 12 of the electrification device 2. The controller 12 controls the amount of electricity fed into the electrification device 2 and timing. The time measurement device 13, which measures the time the electrification device 2 is actuated, is connected with the controller 12 and a signal from the electrification measurement device 11 is input.

Figure 8:
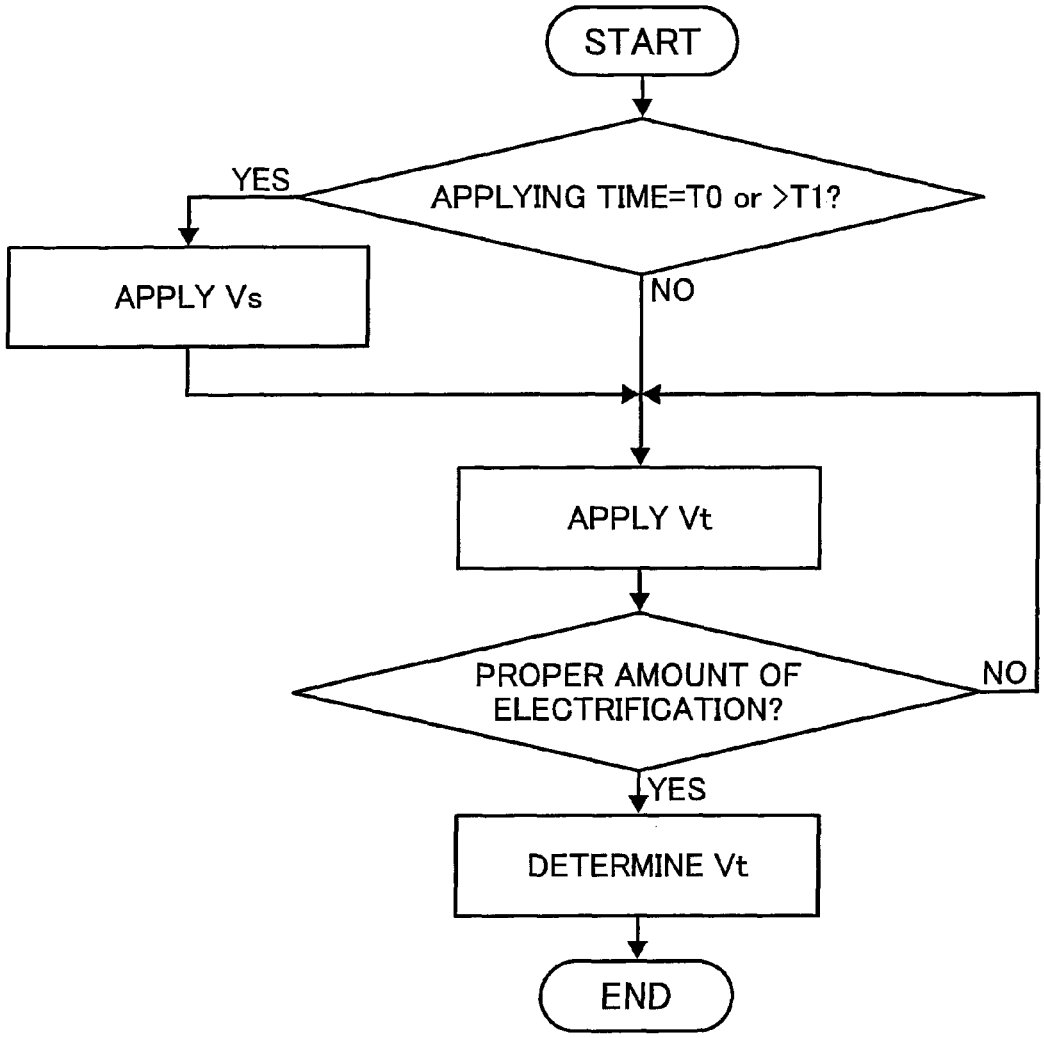
FIG. 8 is a flowchart illustrating an outline of control of the electric charging apparatus of FIG. 2.

FIG. 8 is a flowchart illustrating an outline of control of the electric charging apparatus of FIG. 2. Before charging the photoconductor 1, in early stages of applying voltage, a process is performed for a predetermined time of applying a voltage Vs that is higher than the usual voltage Vt (applied during usual image formation). Voltages Vs are prepared having two or more levels if needed. For example, it is good to choose a voltage level Vs according to environmental conditions, such as humidity. With the operation of image forming, when a total turning-on-electricity time exceeds Tt, which is acquired by measuring the time voltage is applied to the electric charging apparatus, a process of applying for a predetermined time a voltage Vs that is higher than the usual voltage Vt that is applied in the usual image formation process is used. In this case, if the process is performed at the time when there is no image formation, influence on a user can be reduced. In addition, Vt has a nominal value, and when actually applying it, this value is delicately controlled by feedback from the electrification measurement device 11. Then, the voltage Vt stored beforehand in the controller is applied so that the potential of the surface of the photoconductor 1 can be a predetermined potential in the usual image formation operation. The voltage Vt is also controlled so that the photoconductor 1 can have a proper amount of electrifications by a signal from the electrification measurement device 11 at the time of applying voltage Vt, and total (accumulation) time is reset. The high voltage Vs is suitably chosen in the configuration. However, in consideration of deterioration of the surface of the photoconductor 1 at the time of applying higher voltage etc., the electric discharge starting potential of the Paschen rule is used here.

Figure 9:
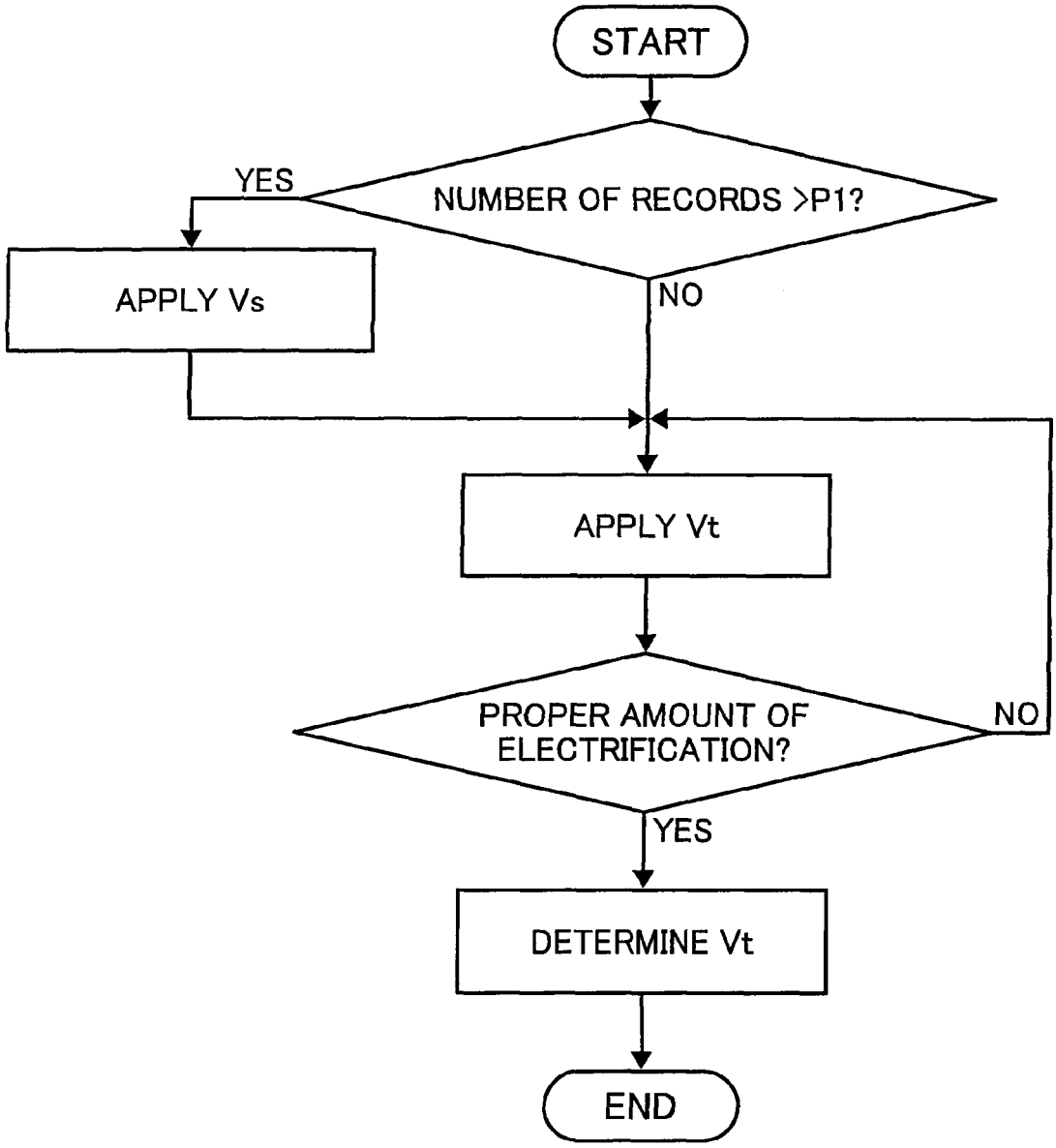
FIG. 9 is a flowchart illustrating an outline of another example of control of the electric charging apparatus of FIG. 2.

FIG. 9 is a flowchart illustrating an outline of another example of control of the electric charging apparatus of FIG. 2. The controller is capable of measuring the number of sheets P1 in the image formation. When the number of sheets P1 exceeds a predetermined number of sheets, a process of applying voltage Vs higher than the usual voltage Vt (applied as part of usual image formation) is performed for a predetermined time. Similar to the above-mentioned FIG. 8 control, it is best to perform the FIG. 9 process at the time when there is no image formation. After that, the voltage Vt used for usual image formation is determined like the above-mentioned FIG. 8 control. The number of sheets P1 is also reset. Since the electronic discharge section tends to have a little deterioration, the voltage Vs can be applied for a predetermined time every time there is no image formation. The object of applying higher voltage (Vs) to the electronic discharge section having a value higher than a voltage applied for providing a predetermined potential on the surface of the photoconductor 1 for the usual recording operation is to increase the field intensity. This results in desirably raising the efficiency of the electronic discharge element by increasing field intensity.

Figure 10:
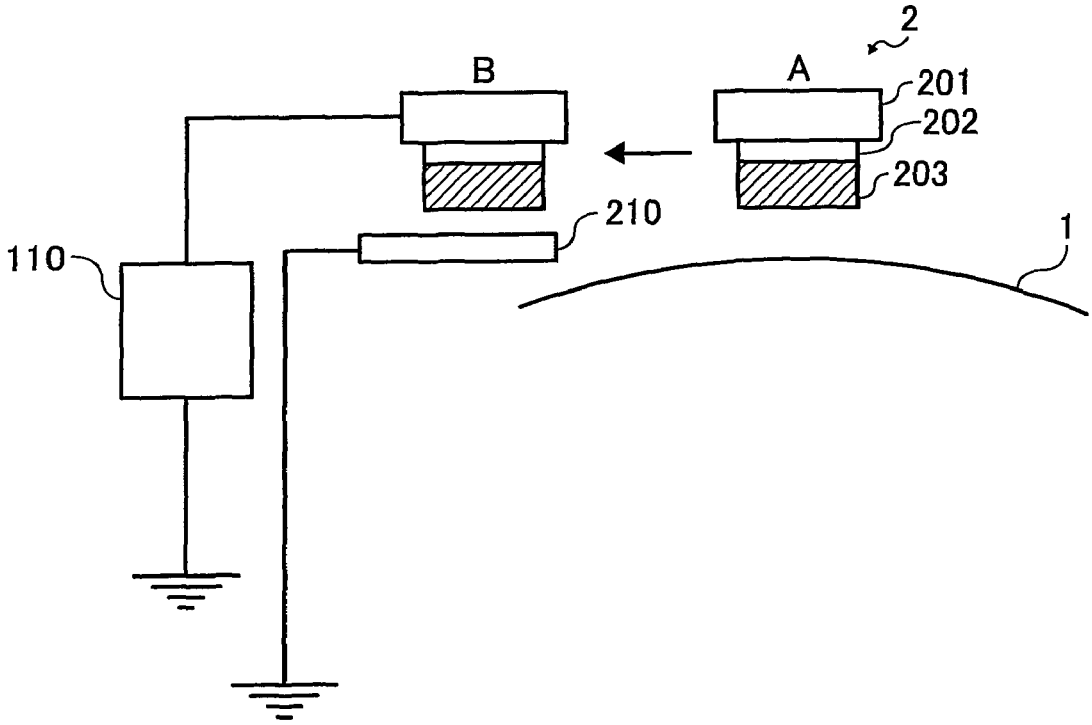
FIG. 10 is a cross-sectional diagram for explanation of an electric charging apparatus according to an exemplary embodiment of the present invention.

FIG. 10 is a cross-sectional diagram for explanation of an electric charging apparatus according to an exemplary embodiment of the present invention. In FIG. 10, the electric charging apparatus 2 includes the support member 201, the electrode 202, the electron discharge layer 203, and a second opposite electrode 210. The support member 201, the electrode 202, and the electron discharge layer 203 are so provided that the surface of the electron discharge layer 203 faces the photoconductor 1 spaced a predetermined distance apart. The electric charging apparatus 2 is supported by a support member capable of moving in a vertical direction to the shaft of the photoconductor 1 that is not shown. The second opposite electrode 210 is so provided and fixed that the gap between the electron discharge layer 203 and the second opposite electrode 210 is shorter than the gap between the electron discharge layer 203 and the photoconductor 1. The second opposite electrode 210 is made of conductive material. The electric charging apparatus 2 is operated at the illustrated position "A" facing the photoconductor 1 when the usual image recording is in operation. When the high voltage (Vs) mentioned as to FIG. 5 is temporarily applied in the process of providing a high field intensity, the electric charging apparatus 2 is moved to the illustrated position "B" facing the second opposite electrode 210 so that the high field intensity does not effect the photoconductor 1. The applying of the above-mentioned high voltage (Vs) to make the high field intensity only occurs at position "B", the voltage occurring at the time of the usual record operation is applied to the electric charging apparatus 2 at position "A". Since the distance between the electron discharge layer 203 and the second opposite electrode 210 is short at position "B", high field intensity is produced and the same refreshing effect as mentioned above is attained.

When applying higher voltage to obtain higher field intensity at position "B" when electric charging apparatus discharge layer 203 is opposite electrode 210, the refreshing effect is increased. Since the second opposite electrode 210 and position "B" are at a position so as not to apply an influence on the photoconductor 1, image formation is also not influenced and the deterioration of the photoconductor 1 when the photoconductor 1 faces the electron discharge element having a higher voltage is avoided. Therefore, the configuration of the second opposite electrode 210 and the two positions for the electron discharge section 2 according to this embodiment are preferable to attain high field intensity. The configuration is not limited to the illustrated example. Any other configuration in which field intensity can be applied that is higher than that used during image formation is possible.

Next, 5H—BN and 6H—BN (boron nitride) are explained. Above-mentioned SP3-bonded BN (SP3-bonded 5H—BN, 6H—BN) is a preferable material the present inventors have determined possesses a good electron discharge characteristic, especially in air. A SP3-bonded BN film, which has a form of sharpened tip for obtaining a good characteristic of electric field electron discharging, can be formed. Such a formed film has good characteristics including a low threshold for electric field electron discharging, a high current density, and a long electronic discharge life. The preferred electric field electron discharging boron nitride material can be obtained as described below.

This process includes the deposition of the boron nitride on a substrate by the reaction from the gaseous phase while energy-rich ultraviolet light is irradiated near the substrate. The boron nitride film formed on the substrate has a sharpened tip that grew up by itself toward the ultraviolet light at a suitable interval from the surface of the film. When an electric field is applied to this sharpened tip film, it provides an improved electron discharge. This boron nitride film is a good electron discharge material because it maintains stable performance while keeping a considerably high current density without deterioration of the boron nitride film. To provide the self formation of the sharpened tip, irradiating with the above-noted ultraviolet light is necessary. This is described again in the detailed discussion of generating the material.

The surface formation by self-organization is believed to be due to the so-called "Turing structure," which appears when the surface diffusion and the surface chemical reaction of a precursor substance compete. It is theorized that the ultraviolet light irradiation provides for photochemistry promotions and affects a regular distribution of an initial core. Thus, the ultraviolet light irradiation increases the growth reaction on the surface. This means that the reaction velocity is proportional to the optical intensity. If it is assumed that the initial core has a hemisphere form, then the optical intensity is large and the growth is promoted near the center. However, the optical intensity is weaker and the growth is slowed at a circumferential edge. This is considered to be one of the formation factors of the surface formation in which the tip is sharpened. In any event, it is clear that the ultraviolet light irradiation plays a very important role in providing the peak. The exact method of generation of this boron nitride film is explained next.

Figure 11:
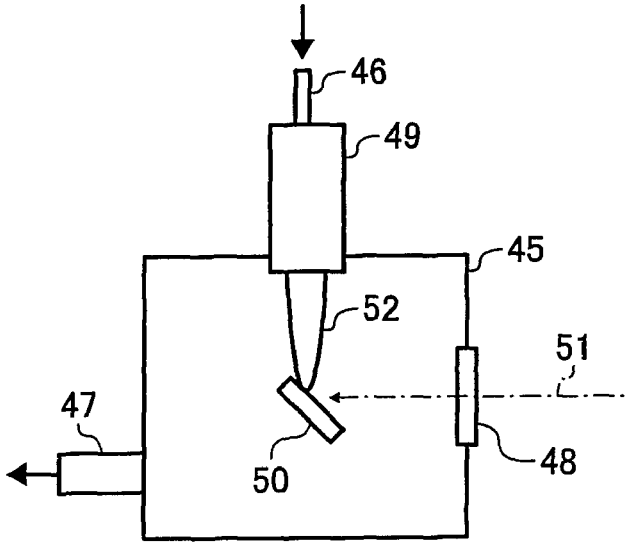
FIG. 11 is a cross-sectional diagram for explanation of a CVD reactor to obtain an SP3-bonded BN film according to an exemplary embodiment of the present invention.

FIG. 11 is a cross-sectional diagram of a CVD reactor to obtain a SP3-bonded BN film according to an exemplary embodiment of the present invention. FIG. 11 illustrates a reactor (reaction furnace) 45, a gas entry part 46, a gas exit part 47, an optical window 48, a plasma torch 49, a substrate 50, an excimer ultraviolet laser light beam 51, and a plasma 52. This configuration of the CVD reactor is used for a gaseous phase reaction to obtain the SP3-bonded BN film having the good characteristics for the electron discharge firm of the present invention. The reactor 45 has the gas entry part 46 to introduce reactive gas and its dilution gas. The reactor 45 also has the gas exit part 47 to provide an exit for the reactive gas, etc., which is connected with a vacuum pump and maintained below atmospheric pressure. The substrate 50 on which the boron nitride film is deposited is provided in the gas flow. The excimer ultraviolet laser light beam 51 irradiates the substrate 50 through the optical window 48 that faces the substrate 50.

The reactive gas is excited by the ultraviolet light on the substrate, and a gaseous phase reaction occur between the source of nitrogen and the source of boron in the reactive gas. Then, SP3-bonded BN having a structure of 5H type multi-form or 6H type multi-form shown by a general formula:BN generates on the substrate. It deposits and grows up in the shape of a film having a sharpened tip as noted above. A pressure in the reactor 45 in this case can be provided over a large range of 0.001-760 Torr. Although the temperature of the substrate 50 installed in the reactor can also vary over a large range from room temperature −1300 degrees C., it is desirable for pressure to be low and temperature to be high, in order to acquire the target reaction product having a high purity.

When irradiating the ultraviolet light beam 51 for the substrate excitation, it is also preferred to irradiate the plasma 52 with the excimer ultraviolet laser light beam 51. In FIG. 11, the plasma torch 49 is used for this method. The reactive gas entry part 46 and the plasma torch 49 are provided so that both face toward the substrate in order to have both the reactive gas and the plasma 52 easily interact with the substrate. More concrete conditions are described next. However, this invention is not limited to only these conditions.

THE EXAMPLE 1 OF A GENERATION CONDITION

A 10 sccm of diborane flow and a 20 sccm of ammonia flow were introduced into the mixed dilution gas of a 2 SLM of argon flow and a 50 sccm of hydrogen flow. At the same time, an excimer laser ultraviolet light beam was irradiated on the silicon substrate at 800 degrees C. by heating in the atmosphere maintained at a pressure of 30 Torr by pumping. The desired thin film was obtained in 60 minutes. The thin film generated was identified using the X-ray diffraction method. The specimen was hexagonal crystal having a structure of SP3-bonded 5H type multi-form, and grating constants: a=0.25 nm and c=1.04 nm. Using a scanning electron microscope to form an image, it was observed that the unique surface form of this thin film is included a conic projection structure (having a length of 0.001 micrometers—a few micrometers) providing the sharpened tip where an electric field is concentrated.

In order to examine the field-electron-discharge characteristic of this thin film, voltage was applied between the thin film and the electrodes in a vacuum with a 1 mm-diameter-cylindrical-metal electrode which is separated from the surface by 30 micrometers . As a result of measuring the amount of electron discharge in a field intensity of 15-20 (V/μm), current density over this range was noted to increase. At the field intensity of 20 (V/μm), the current density was saturated at the demarcation current value (corresponding to 1.3 $A/cm^2$) of the high-voltage power supply used for measurement. Although a little variation of the current was recognized for about 15 minutes during the measurement, almost an average current value was maintained, and no decrease of the current value due to a deterioration of the material was recognized. Therefore, the material is stable. Furthermore, even when the examination was carried out in air, the result of characteristic was almost equivalent. Moreover, even when the thin film was ground in the shape of a fine particle (0.0005-1 μm), and it was made into paste and formed into film, being dried and examined, the result of characteristic was also almost equivalent.

THE COMPARATIVE EXAMPLE 1 OF A GENERATION

For comparison, the field-electron-discharge characteristic of the same thin film under the same generation condition of the example 1 but without the ultraviolet light beam irradiation was examined. As a result, the threshold value field intensity for the start of an electronic discharge was 42 (V/μm). It was considerably higher than the value of 15 (V/μm) seen above as to the thin film formed with ultraviolet in a direction used with example 1. Moreover, observation of the comparative example 1 film with the scanning electron microscope showed damage and exfoliation of the thin film by field electron discharge. On the other hand, at the portion of the projection surface grown under the ultraviolet light conditions associated with example 1, such damage was not found after the experiment inducing the field-electron-discharge.

THE EXAMPLE 2 OF A GENERATION EXAMPLE

A 10 sccm of diborane flow and a 20 sccm of ammonia flow were introduced into the mixed dilution gas of a 2 SLM of argon flow and a 50 sccm of hydrogen flow. At the same time, an excimer laser ultraviolet light beam was irradiated on the silicon substrate at 900 degrees C. by heating in the atmosphere with RF plasma of 800 W output and 13.56 MHz frequency, being maintained at a pressure of 30 Torr by pumping. The desired thin film was obtained in 60 minutes. The thin film generated was identified using the X-ray diffraction method like the above-noted example 1. The specimen was hexagonal crystal having a structure of SP3-bonded 5H type multi-form, and grating constants: a=0.25 nm and c=1.04 nm. Using the scanning electron microscope to again form an image, it was observed that the unique surface form of this thin film is also a conic projection structure (having a length of 0.001 micrometers—a few micrometers) and providing the sharpened tip where an electric field is concentrated.

In order to examine the field-electron-discharge characteristic of this thin film, voltage was applied between the thin film and the electrodes in a vacuum with a 1 mm-diameter-cylindrical-metal electrode which is separated from the surface by 40 micrometers. As a result of measuring the amount of electron discharge, in a field intensity of 18-22 (V/μm), current density over this range increased. At the field intensity of 22 (V/μm), the current density was saturated at the demarcation current value (corresponding to 1.3 $A/cm^2$) of the high-voltage power supply used for measurement. Furthermore, even when the examination was carried out in air, the result of characteristic was almost equivalent. Moreover, although the thin film was ground in the shape of a fine particle (0.0005-1 μm), and it was made into a paste and formed into film, being dried and examined, the result of characteristic was also almost equivalent. Therefore, the material is stable like the example 1 of the generation condition.

THE EXAMPLE 3 OF A GENERATION CONDITION

A 10 sccm of diborane flow and a 20 sccm of ammonia flow were introduced into the mixed dilution gas of a 2 SLM of argon flow and a 50 sccm of hydrogen flow. At the same time, an excimer laser ultraviolet light beam was irradiated on the nickel substrate at 900 degrees C. by heating in the atmosphere with RF plasma of 800 W output and 13.56 MHz frequency, being maintained at a pressure of 30 Torr by pumping. The desired thin film was obtained in 60 minutes. The thin film generated was identified using the X-ray diffraction method like the above-noted example 1. The specimen was hexagonal crystal having a structure of SP3-bonded 5H type multi-form, and grating constants: a=0.251 nm and c=1.05 nm. Using the scanning electron microscope to again form an image, it was observed that the unique surface form of this thin film is also a conic projection structure (having a length of 0.001 μm—a few micrometers) that provides the sharpened tip where an electric field is concentrated.

In order to examine the field-electron-discharge characteristic of this thin film, voltage was applied between the thin film and the electrodes in a vacuum with a 1 mm-diameter-cylindrical-metal electrode which is separated from the surface by 40 micrometers. As a result of measuring the amount of electron discharge, in a field intensity of 18-22 (V/μm), current density over this range was noted to increase . At the field intensity of 22 (V/μm), the current density was saturated at the demarcation current value (corresponding to 1.2 $A/cm^2$) of the high-voltage power supply for measurement. Furthermore, even when the examination was carried out in air, the result of characteristic was almost equivalent. Moreover, although the thin film was ground in the shape of a fine particle (0.0005-1 μm), and it was made into a paste and formed into film, being dried and examined, the result of characteristic was also almost equivalent. Therefore, the material is stable like example 1 of the generation condition. As mentioned above, the SP3-bonded BN is preferable for use as an electron discharge element in the image forming apparatus of this invention because it has a shape providing for a good electron discharge characteristic. That is, the SP3-bonded BN of this invention has the unique shape with the self-formed sharpened tip.

Not only is a sharpened tip a benefit, the particulate type of the SP3-bonded BN is also a benefit in use. In this regard, the particulate type includes fine particles distributed to be overlapped with each other and forming the shape of an island. The particle diameter is 0.1 nm-1 μm, and is more preferably 0.1 nm-20 nm.

As shown in FIG. 3, the SP3-bonded BN film is formed under the above-mentioned conditions. It is recognized that the SP3-bonded BN film has anisotropy of the rate of electric conduction. Although it has a high rate of electric conduction in the thickness direction of the SP3-bonded BN film, it has a very low rate of electric conduction in a direction parallel to the substrate. This was recognized by measuring the resistance between adjoining electrodes. The reason of the anisotropy of the conductivity is unclear. However, it is clear that an electric conduction path is formed in the direction of film thickness although the SP3-bonded BN film is otherwise an insulator. It can be understood that this electric conduction path relates to the anisotropy.

This invention is not limited to the above-mentioned examples. It is clear that the form of each of the above-mentioned examples may be suitably changed within the limits of this invention. Also, the number of components, a position, form, etc., are not limited to the form disclosed in each of the above-mentioned examples, when carrying out this invention, they may have a suitable number, a position, form, etc.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2006-091233 filed on Mar. 29, 2006 in the Japan Patent Office, the entire contents of which are incorporated herein by reference.

The invention claimed is:

1. An electric charging apparatus to charge a surface of a charging object, comprising:

an electric field forming device including, two electrodes facing each other to form an electric field therebetween, wherein an electron discharging member is provided at a portion of one of the two electrodes that faces the other electrode and is configured to discharge electrons into the electric field; and a voltage applying controller to control a voltage applied to the two electrodes, wherein the voltage applying controller also selects two or more nonzero intensities of the electric field, and an electric field intensity for charging a predetermined amount of electrons onto the charging object is lower than an electric field intensity which is one of the two or more nonzero electric field intensities.

2. The electric charging apparatus of claim 1, wherein the electron discharging member includes an SP3-bonded material.

3. The electric charging apparatus of claim 2, wherein the SP3-bonded material is an SP3-bonded boron nitride.

4. The electric charging apparatus of claim 3, wherein the SP3-bonded boron nitride has a crystal structure of 5H or 6H.

5. The electric charging apparatus of claim 1, wherein, at a beginning stage of forming the electric field for charging the predetermined amount of electrons onto the charging object, an electric field intensity is set to one of the two or more nonzero electric field intensities.

6. An image forming apparatus, comprising:

an electric charging apparatus to charge a surface of a charging object including, an electric field forming device including two electrodes facing each other to form an electric field therebetween, wherein an electron discharging member is provided at a portion of one of the two electrodes that faces the other electrode and is configured to discharge electrons into the electric field, and a voltage applying controller to control a voltage applied to the two electrodes, wherein the voltage applying controller selects two or more nonzero intensities of the electric field, and an electric field intensity for charging a predetermined amount of electrons onto the charging object is lower than an electric field intensity which is one of the two or more nonzero electric field intensities.

7. The image forming apparatus of claim 6, wherein, at a time of not forming an image, an electric field intensity is set to be of a value higher than a value used when forming the image.

8. The image forming apparatus of claim 7, wherein, at every time of passing a predetermined accumulating time, the electric field intensity is set to be of a value higher than a value used when forming an image.

9. The image forming apparatus of claim 7, wherein, at every time of accumulating a predetermined number of pages having formed images, the electric field intensity is set to be of a value higher than the value used when forming the image.

10. The image forming apparatus of claim 6, wherein an electric field intensity is set to be of a value higher than a value used when forming an image without affecting the surface of the charging object.

11. The electric charging apparatus of claim 1, wherein the electric field intensity, which is the one of the two or more nonzero electric field intensities, is an electric discharge starting potential of the Paschen Rule.

12. The image forming apparatus of claim 6, wherein the electric field intensity, which is the one of the two or more nonzero electric field intensities, is an electric discharge starting potential of the Paschen Rule.

13. The image forming apparatus of claim 10, wherein the one of the two electrodes in which the electron discharging member is provided is movable from a first position at which the image is formed to a second position when a high field intensity is produced.

14. The image forming apparatus of claim 9, wherein, when the predetermined number of pages having formed images has been accumulated, the electric field intensity is set to be of the higher value, when there is no image formation.

15. The image forming apparatus of claim 13, wherein the charging object is a photoconductor drum, the electron discharging member is spaced a first predetermined distance apart from the photoconductor drum at the first position, and the electron discharging member is spaced a second predetermined distance apart from the other electrode at the second position, the second predetermined distance being shorter than the first predetermined distance.

16. The image forming apparatus of claim 15, wherein the voltage applying controller applies a first intensity of the two or more nonzero intensities of the electric field at the first position, the voltage applying controller applies a second intensity of the two or more nonzero intensities of the electric field at the second position, the second intensity being higher than the first intensity.

17. The image forming apparatus of claim 16, wherein the voltage applying controller applies the second intensity only at the second position.

18. An electric charging apparatus to charge a surface of a charging object, comprising:

an electric field forming device including, two electrodes facing each other to form an electric field therebetween, wherein an electron discharging member is provided at a portion of one of the two electrodes that faces the other electrode and is configured to discharge electrons into the electric field; and a voltage applying controller to control a voltage applied to the two electrodes, wherein the voltage applying controller also selects two or more nonzero intensities of the electric field, and wherein an electric field intensity for charging a predetermined amount of electrons onto the charging object is lower than an electric field intensity which is one of the two or more nonzero electric field intensities.

19. An image forming apparatus, comprising:

an electric charging apparatus to charge a surface of a charging object including, an electric field forming device including two electrodes facing each other to form an electric field therebetween, wherein an electron discharging member is provided at a portion of one of the two electrodes that faces the other electrode and is configured to discharge elections into the electric field, and a voltage applying controller to control a voltage applied to the two electrodes, wherein the voltage applying controller selects two or more nonzero intensities of the electric field, and wherein an electric field intensity for charging a predetermined amount of electrons onto the charging object is lower than an electric field intensity which is one of the two or more nonzero electric field intensities.

* * * * *